United States Patent [19]

Addison

[11] Patent Number: 4,700,524

[45] Date of Patent: Oct. 20, 1987

[54] TONGUE AND GROOVE TAPERED PLANKS

[76] Inventor: Barrie D. G. Addison, 6180 Tisdall Street, Vancouver, British Columbia, Canada, V5Z 3N4

[21] Appl. No.: 889,120

[22] Filed: Jul. 24, 1986

[51] Int. Cl.[4] ..... E04C 1/04

[52] U.S. Cl. ..... 52/593; 52/574; 144/85

[58] Field of Search ..... 52/584–595, 52/574; 138/157, 162; 144/85, 352, 356, 357

[56] References Cited

U.S. PATENT DOCUMENTS

| | | | |
|---|---|---|---|
| 667,953 | 2/1901 | Ross | 138/157 |
| 714,251 | 11/1902 | Spencer | 138/157 |
| 781,376 | 1/1905 | Sorensen | 52/574 |
| 944,489 | 12/1908 | Linderman | 144/85 |
| 1,070,572 | 8/1913 | Wyckoff | 52/594 |
| 1,110,008 | 9/1914 | Ripley | 138/162 |
| 4,106,254 | 8/1978 | Jack et al. | 52/574 |

*Primary Examiner*—James L. Ridgill, Jr.

[57] ABSTRACT

A finished construction plank processed from a log having sides chipped to a hexagonal profile to form tapered flattened surfaces along the longitudinal length of the log and cut to form a top and bottom half having a middle surface wherein each half is cut with at least one of a tongue and groove on each side extending parallel the middle surface along the longitudinal length of the plank.

15 Claims, 7 Drawing Figures

TONGUE AND GROOVE TAPERED PLANKS

FIELD OF THE INVENTION

This invention relates to forest products and more particularly to tongue and groove tapered planks derived from small trees.

DESCRIPTION OF THE PRIOR ART

The forest industry is becoming aware that increasing use must be made of small trees in order to reduce the harvest rotation cycle and hence the economic value of the forest resource. The normal processing method is to chip and/or cut the stems from these small trees into lumber. But on these small diameter trees with very small unit volumes, this normal process is not productive enough nor is the recovery high enough.

SUMMARY OF THE INVENTION

It is therefore a primary object of this invention to provide a finished product which offers about 70% recovery from the stem of small trees.

Another object of the present invention is to provide tapered planks processed from small stems with a tapered, hexagonal profile and tongue and grooves on the sides.

Yet another object of the present invention is to provide a structure made of tapered, tongue and groove planks having an underside and a topside lying on parallel planes when one of the tapered halves is rotated so that the butt end of one half lies adjacent the top end of the other half and their tongue and grooves engaged.

In yet another object of the present invention is to provide tongue and groove planks which have a single taper along the width of the plank.

Accordingly, an aspect of the present invention is to provide a finished construction plank processed from a log having sides chipped to a hexagonal profile to form tapered flattened surfaces along the longitudinal length of the log and cut to form a top and bottom half having a middle surface wherein each half is cut with at least one of a tongue and groove on each side extending parallel said middle surface along the longitudinal length of said plank.

DRAWINGS

These and other objects of the present invention will be understood in conjunction with the accompanying drawings in which.

DESCRIPTION OF THE PREFERRED EMBODIMENTS

Figure 1:
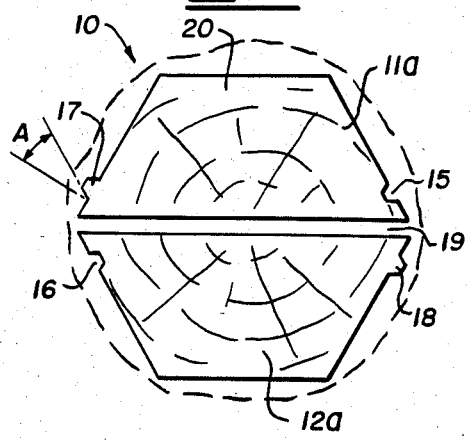
FIG. 1 is a bottom view of tapered planks according to one embodiment of the present invention.
Figure 2:
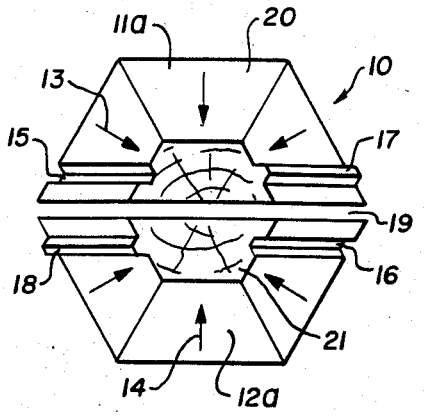
FIG. 2 is a top view thereof.

Referring now to FIGS. 1 and 2, we have shown at reference numeral 10 a bottom view or butt end 20 of a finished log product according to the present invention. This log product basically consists of two tapered planks ll*a* and 12*a* which are derived from small stems which have been cut in half while the sides are chipped to a tapered, hexagonal profile as more clearly shown in FIG. 2. As seen from the top end 21 of the tree, each half log is tapered both on the width dimension, as depicted by arrows 13 and along the depth as depicted by arrows 14. Tapered planks ll*a* and 12*a* are cut in such a way as to provide a set of grooves 15 and 16 and tongues 17 and 18.

The tongue and grooves, which can be either single or double depending on the size of the tapered plank, have a 30 degree angle A on their edges so that they can be easily machined and engaged.

For example, tapered plank ll*a* and 12*a* of FIGS. 1 and 2 have single tongue and grooves. A tongue is cut on one side of the plank and a groove on the other side thereby creating reciprocal planks.

Figure 3:
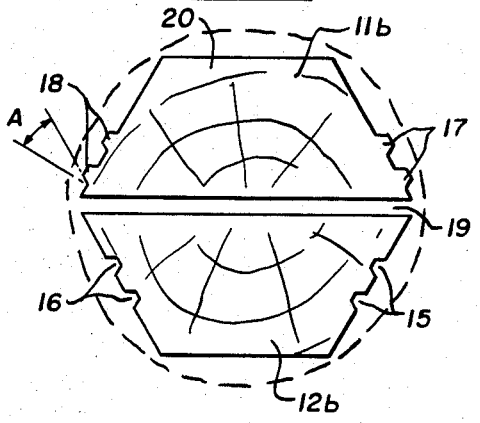
FIG. 3 is a bottom view of tapered planks according to a second embodiment of the invention.
Figure 4:
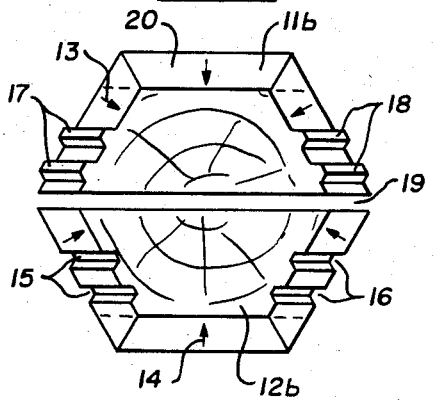
FIG. 4 is a top view thereof.

Tapered planks ll*b* and 12*b* shown in FIGS. 3 and 4 are provided with double tongue and groove cuts.

However, tapered plank ll*b* is cut with double tongues on each side and tapered plank 12*b* is cut with double grooves on each side.

Figure 5:
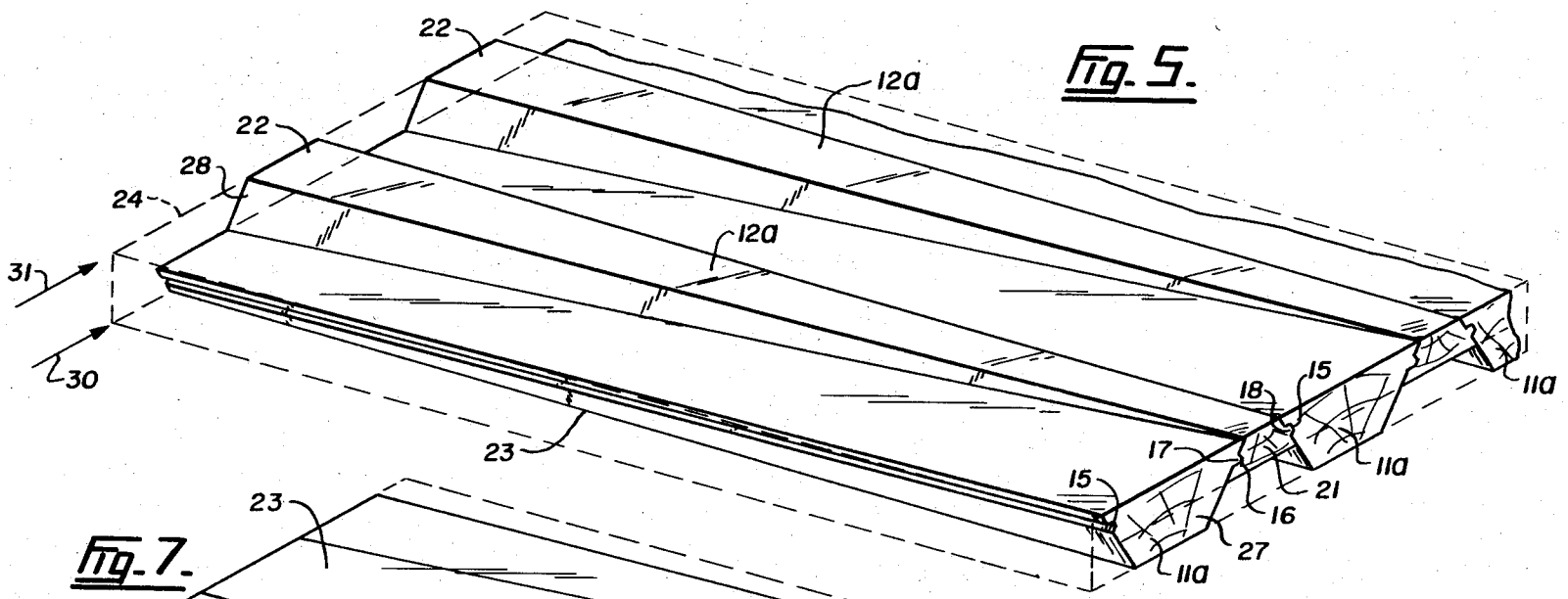
FIG. 5 is a structure made with the tapered planks shown in FIGS. 1 and 2.

Referring now to FIG. 5 we have shown a structure which can be made from combining a plurality of these tapered, tongue and groove planks. By using tongue and grooves which are parallel to the center surface or saw cut 19, a structure can be made having an underside, depicted by arrow 30 and a top side, depicted by arrow 31 lying on parallel planes.

This is achieved when tapered plank 11*a* is rotated along the longitudinal plane of the log into the position shown in FIG. 5. As can be seen, groove 15 of tapered plank ll*a* will engage with tongue 18 of tapered plank 12*a* to form a structure in which the top side 22 of tapered plank 12*a* will be along plane 31 and parallel to bottom side 23 of tapered plank ll*a* which lies along plane 30. The addition of other tapered planks will form a box-like structure such as depicted by phantom line 24. The top sides 22 of the rotated tapered plant 12*a* will be on a parallel plane to the plane formed by bottom sides 23 of tapered plank ll*a*.

Figure 6:
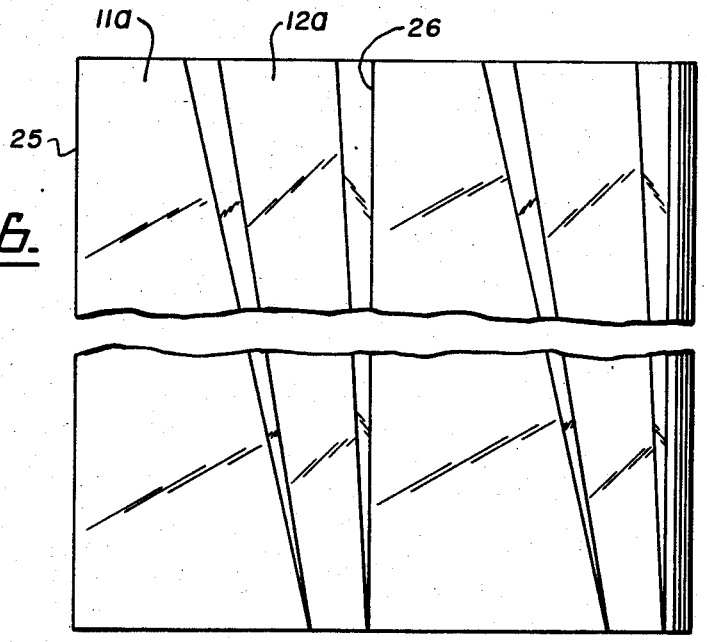
FIG. 6 is a top view thereof.

Referring now to FIG. 6 we have shown that each pair of tongue and groove tapered planks form a section with parallel side edges. That is, side edge 25 of tapered plank ll*a* is parallel to side edge 26 of tapered plank 12*a*. The outline of these paired halves forms a rectangular section. This property allows one of the pair of tapered planks to sit flat on supports while the other piece forms a surface parallel to the supports. Thus, when the profiles 27 and 28 are filled, the flat, top surface is indistinguishable from that formed with conventional sheathing products.

The strength of the pair of tapered planks is almost uniform along the length so that the filler material need not contribute in any way to the structural properties of the section and hence can be composed of a material with relative weak compressive strength. Foamed cement with various additives satisfies these requirements and is inexpensive.

If the quality of the surfaces is a problem, the tapered planks, secured in the same configuration shown in FIG. 2, can be re-machined to a slightly smaller size after drying with the same processor as used to cut and machine them originally.

Figure 7:
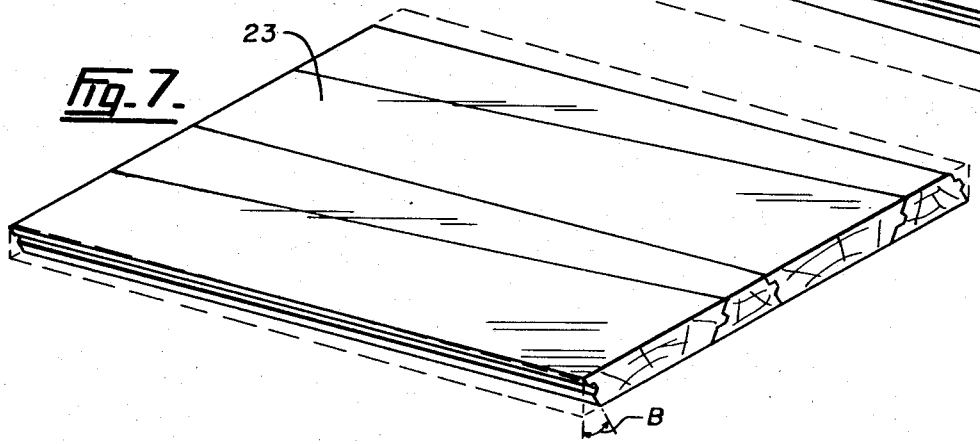
FIG. 7 is another embodiment of the tapered plank structure shown in FIG. 5.

If a flat surface on the top and bottom is desired, the taper depicted by arrow 14 of FIG. 2 could be removed by simply fixing the side chippers at the depth of the top section while re-machining the tapered planks. This product is shown in FIG. 7 and is comprised of tapered planks which have a single taper along the width as depicted by arrow 13 in FIG. 2. Pairs of these single tapered planks will form a rectangular section depicted in FIG. 7 which is identical to conventional tongue and groove planking except for the 30 degree angle B on their edges.

These tongue and groove tapered planks can easily be formed with two simple machining operations. A double arbor saw with profiling chippers on either side and a pair of side chippers, both of which move-in with the pre-determined taper of the stem. These simple manufacturing operations are well known in the art and need not be discussed further.

I claim:

1. A finished construction plank processed from a log having sides chipped to an hexagonal profile to form tapered flattened surfaces along the longitudinal length of the log, said log being cut to form a top and bottom half each having a saw cut surface, each of said top and bottom half thereby forming a plank which is tapered along the width and depth dimensions and wherein each plank is cut with at least one of a tongue and groove on each side extending parallel said saw cut surface along the longitudinal length of said plank.

2. A finished construction plank as defined in claim 1 wherein said half planks are tapered along their widths only.

3. A finished construction plank as defined in claim 2 wherein said top and bottom halves define a structure having a flat underside and top sidy lying on parallel planes when said top half is rotated along the longitudinal plane and positioned adjacent said bottom half such that a tongue of said bottom half is engaged with a groove of said top half.

4. A finished construction plank as defined in claim 1 wherein said top and bottom halves define a structure having a flat underside and top side lying on parallel planes when said top half is rotated along the longitudinal plane and positioned adjacent said bottom half such that a tongue of said top half is engaged with a groove of said bottom half.

5. A finished construction plank as defined in claim 1 wherein each plank is cut with a tongue and a groove on opposite sides extending parallel said saw cut surface along the longitudinal length of said plank such that said top and bottom halves are reciprocal.

6. A finished construction plank as defined in claim 5 wherein said top and bottom halves can be assembled to defined a structure having an underside and a top side lying on parallel planes when said top half is rotated along the longitudinal plane and positioned adjacent said bottom half such that a tongue of said bottom half is engaged with a groove of said top half and wherein longitudinal tapered grooves are defined in said structure by each plank.

7. A finished construction plank as defined in claim 6 wherein said tongue and groove have a 30° angle on their edges.

8. A finished construction plank as defined in claim 6 wherein a section of said structure defined by a pair of tapered planks has parallel side edges.

9. A finished construction plank as defined in claim 1 wherein said top half is cut with tongues on opposite sides extending parallel said saw cut surface and said bottom half is cut with grooves on opposite side extending parallel said saw cut surface.

10. A finished construction plank as defined in claim 9 wherein said top and bottom halves can be assembled to define a structure having an underside and a top side lying on parallel planes when said top half is rotated along the longitudinal plane and positioned adjacent said bottom half such that a tongue of said top half is engaged with a groove of said bottom half and wherein longitudinally tapered grooves are defined in said structure of each plank.

11. A finished construction plank as defined in claim 10 wherein said tongue and groove have a 30° angle on their edges.

12. A finished construction plank as defined in claim 10 wherein a section of said structure defined by a pair of tapered planks has parallel side edges.

13. A stuctural sheathing material assembled from finished construction planks processed from a log having sides chipped to an hexagonal profile to form tapered flattened surfaces along the longitudinal length of the log, said log being cut to form a top and bottom half having a saw cut surface, each of said top and bottom half thereby forming a plank which is tapered along the width and depth dimensions, each plank is cut with at least one of a tongue and groove on each side extending parallel said saw cut surface along the longitudinal length of said plank, and wherein said sheathing material is formed when said top half is rotated along the longitudinal plane and positioned adjacent said bottom half such that a tongue and a groove of said planks become engaged and wherein longitudinally tapered grooves are defined in said structure by each plank.

14. A finished constuctuion plank as defined in claim 13 wherein said tongue and groove have a 30° angle on their edges.

15. A finished construction plank as defined in claim 13 wherein a section of said structure defined by a pair of tapered planks has parallel side edges.

* * * * *